US006325429B1

(12) United States Patent
Oxley

(10) Patent No.: US 6,325,429 B1
(45) Date of Patent: Dec. 4, 2001

(54) ELECTRICALLY OPERATED DOOR LOCK

(76) Inventor: Randall C. Oxley, 22-6 Concord Greene, Concord, MA (US) 01742-3138

( * ) Notice: Subject to any disclaimer, the term of this patent is extended or adjusted under 35 U.S.C. 154(b) by 0 days.

(21) Appl. No.: 09/425,371

(22) Filed: Oct. 22, 1999

Related U.S. Application Data

(60) Provisional application No. 60/105,504, filed on Oct. 23, 1998, and provisional application No. 60/128,770, filed on Apr. 9, 1999.

(51) Int. Cl.[7] ..... E05B 15/02

(52) U.S. Cl. ..... 292/341.16; 292/DIG. 25; 720/277

(58) Field of Search ..... 70/432, 278.7, 70/277; 292/341.16, 341.15, DIG. 25

(56) References Cited

U.S. PATENT DOCUMENTS

| | | | | |
|---|---|---|---|---|
| 297,096 | * | 4/1884 | Woehrle | 292/341.16 |
| 322,681 | * | 7/1885 | Casey | 292/341.16 |
| 358,417 | * | 2/1887 | Summers | 292/341.16 |
| 3,804,442 | * | 4/1974 | Powers | 292/341.16 |
| 3,861,727 | * | 1/1975 | Froerup | 292/341.16 |
| 4,017,107 | | 4/1977 | Hanchett | 292/341.16 |
| 4,211,443 | | 7/1980 | Butts et al. | 292/341.16 |
| 4,633,688 | | 1/1987 | Beudat et al. | 70/279 |
| 4,840,050 | | 6/1989 | Gotanda | 70/107 |
| 5,076,625 | | 12/1991 | Oxley | 292/341.16 |
| 5,127,691 | * | 7/1992 | Herron | 292/341.16 |
| 5,484,180 | | 1/1996 | Helmar | 292/341.16 |

* cited by examiner

*Primary Examiner*—Gary Estremsky
(74) *Attorney, Agent, or Firm*—Hayes, Soloway, Hennessey, Grossman & Hage P.C.

(57) ABSTRACT

A solenoid actuated door lock has a latch keeper which normally is in a locking position to prevent opening of a door. The latch keeper is maintained locked by a locking means which prevents movement of the latch keeper to an unlocked position. The locking means is moved by operation of a solenoid to a position where the keeper can release the door.

18 Claims, 8 Drawing Sheets

RIM PANIC WITH LATCH BOLT MONITORING IN THE FACEPLATE

ELECTRICALLY OPERATED DOOR LOCK

This application is based on my Provisional Patent Application Nos. 60/105,504 and 60/128,770 filed Oct. 23, 1998 and Apr. 9, 1999 respectively the disclosures at which are incorporated herein by reference.

ELECTRICALLY OPERATED DOOR LOCK

The present invention is directed to an electrically operated door release system and more particularly to an improved solenoid actuated system where the locking mechanism retains a latch keeper in locking position to prevent opening of the door. It is specifically designed for use on many different types of doors where the latch keeper can be bypassed by normal operation of the latch, or by solenoid actuation of a locking, mechanism which normally retains the latch keeper in locking position.

The door lock is manufactured as shown in the attached drawings wherein:

FIG. 3 is an end view of FIG. 1 and FIG. 4 is an end view of FIG. 2.

Figure 1:
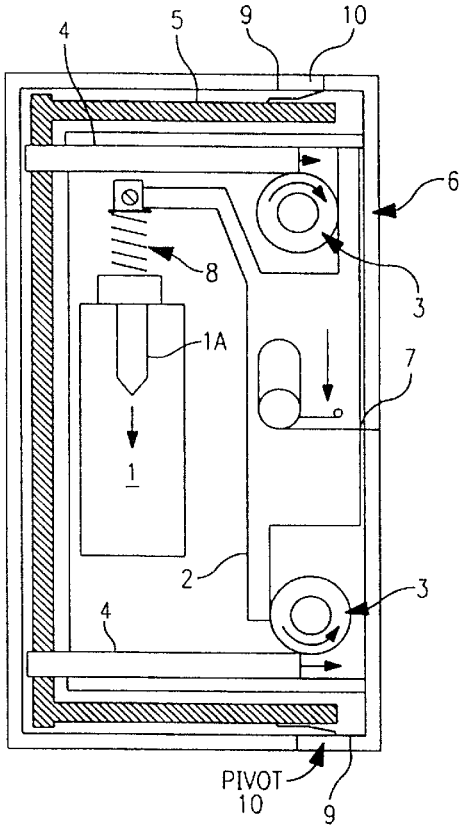
FIG. 1 is a diagramatic schematic plan view of the locking mechanism showing the latch keeper in locking position.
Figure 2:
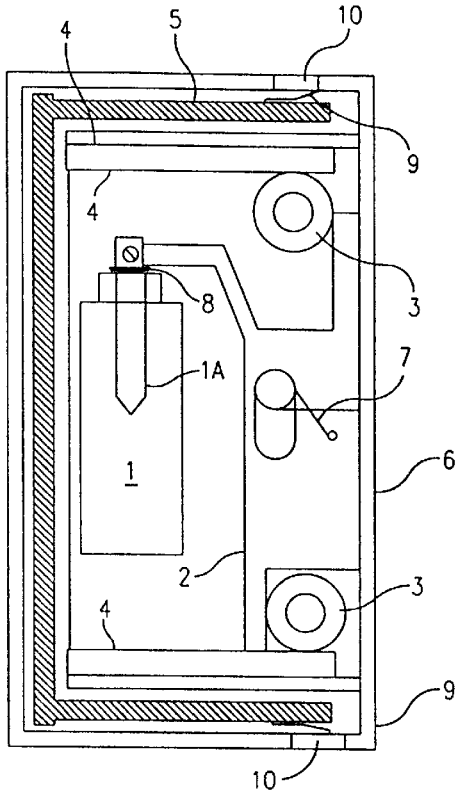
FIG. 2 is a similar schematic plan view showing the locking mechanism after it has been electrically actuated to move it from its locked position to an unlocked position wherein the latch keeper can be depressed by movement of the latch to allow the latch to pass and the door to open.
Figure 6:
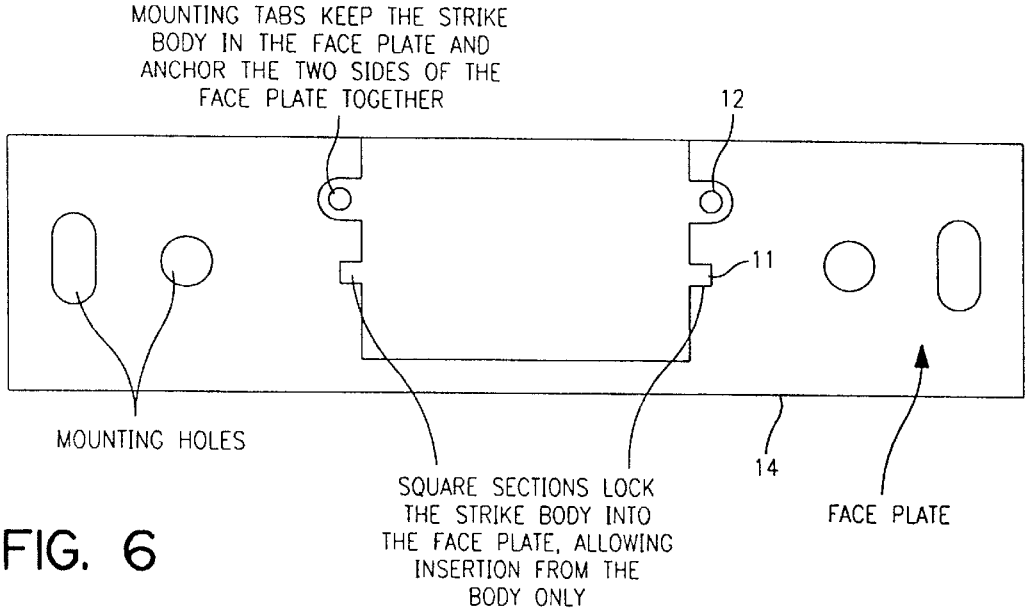
Figure 7:
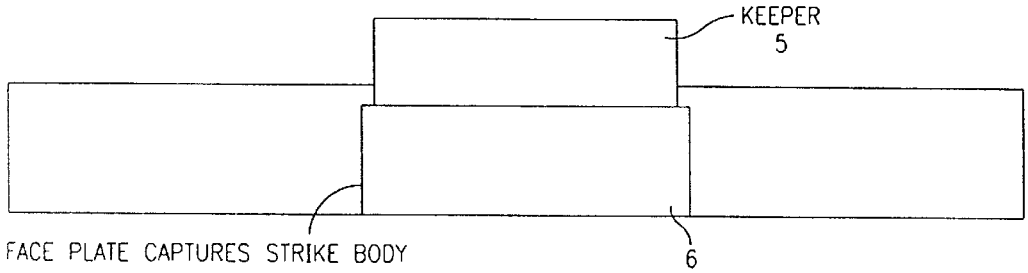
Figure 8:
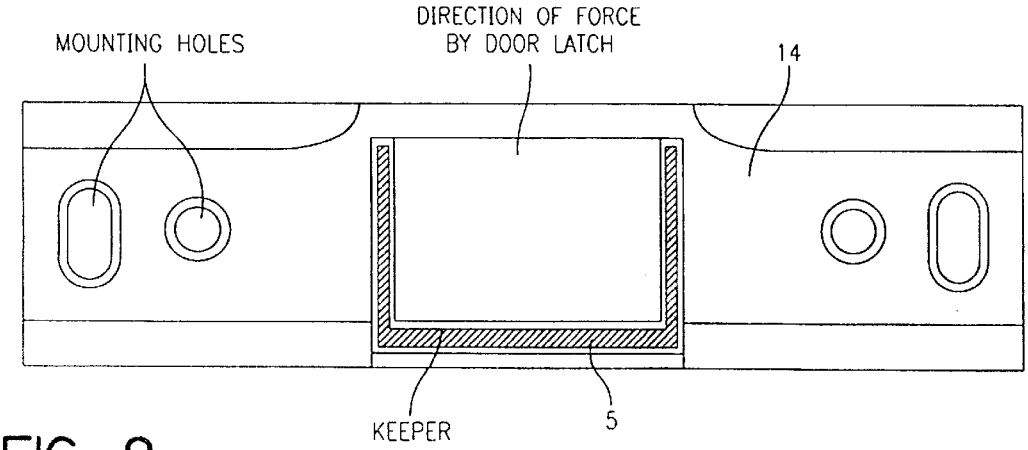
Figure 9:
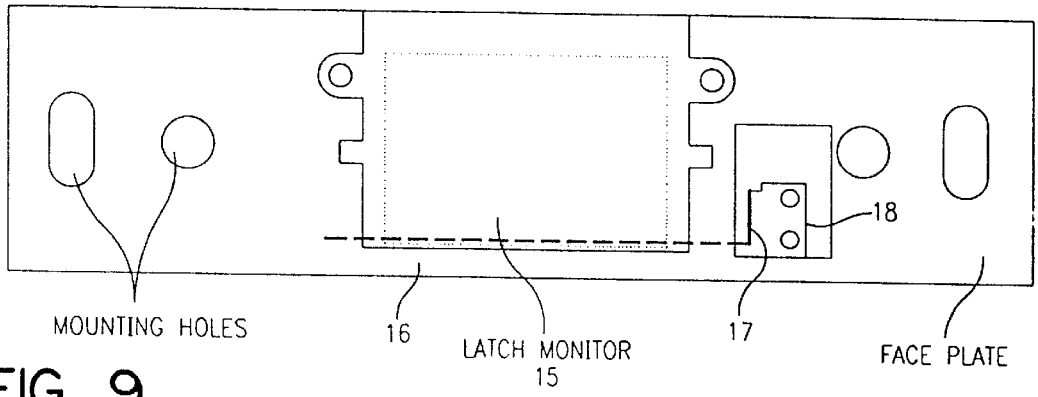
Figure 10:
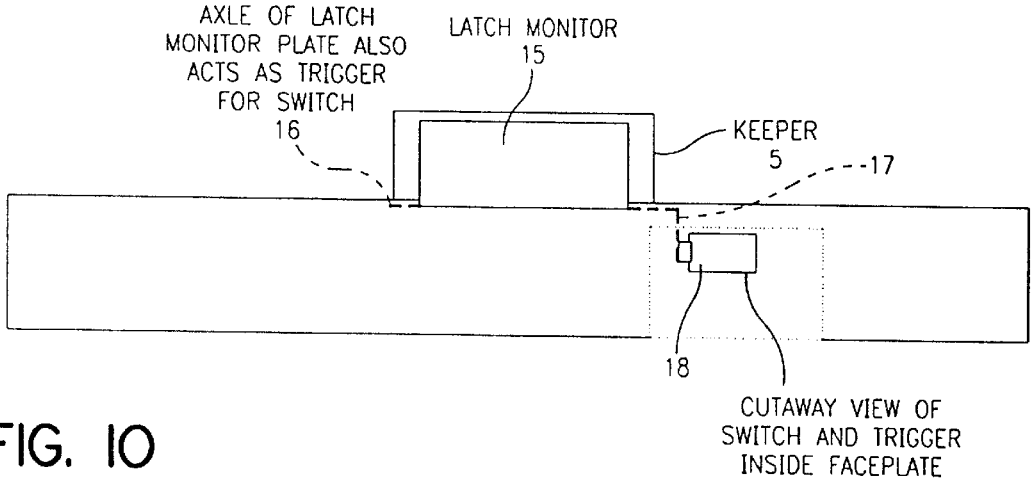
Figure 11:
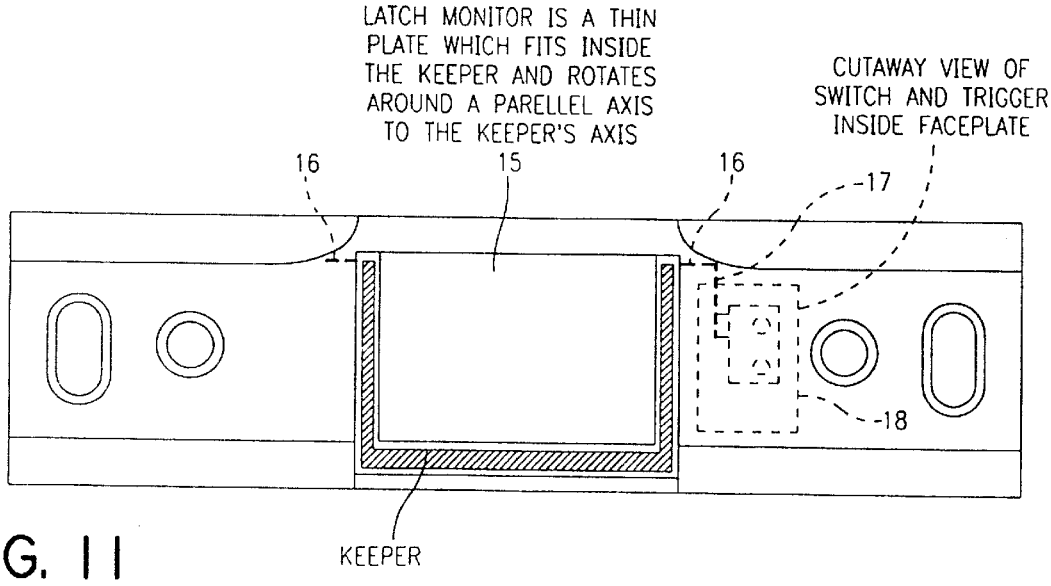
Figure 12:
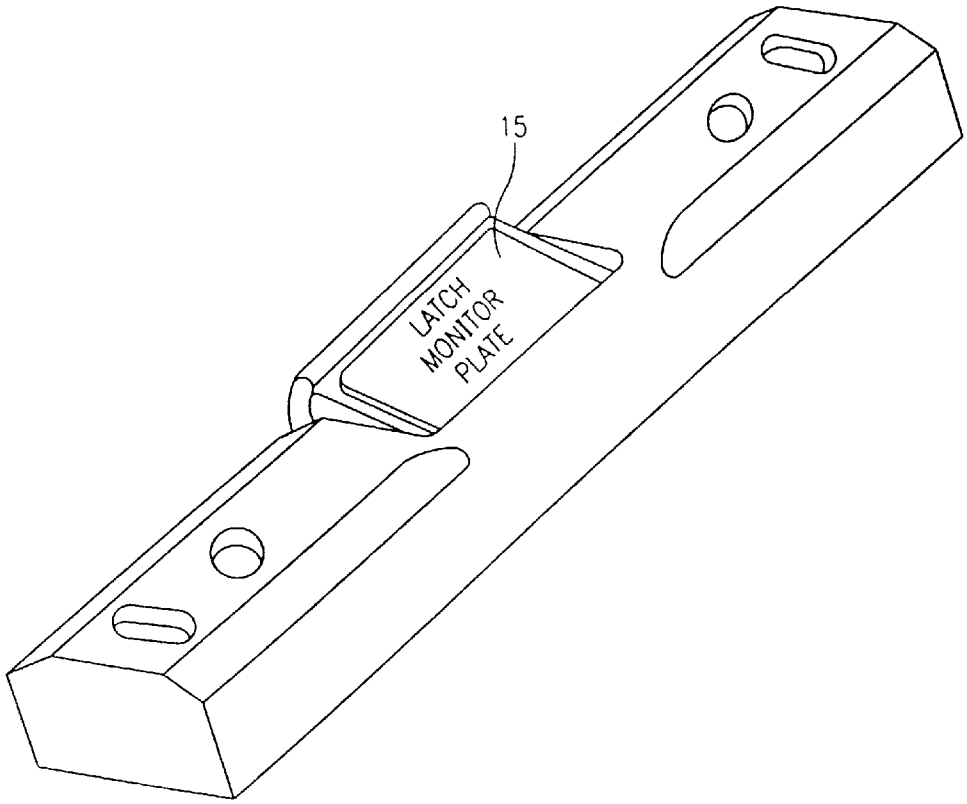

FIG. 6, 7, and 8 shows the relationship of the lock mechanism of FIGS. 1 and 2 to a preferred mounting arrangement in a face plate.

FIG. 9, 10, 11, and 12 illustrate another modification of the invention which includes latch bolt monitoring.

Figure 13A:
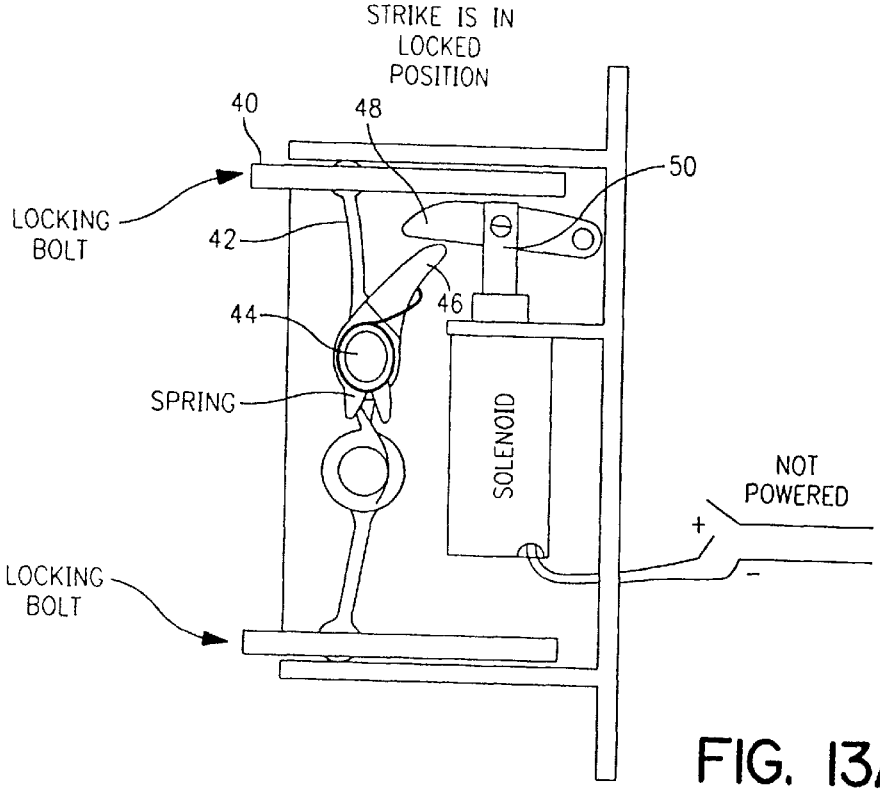
Figure 13B:
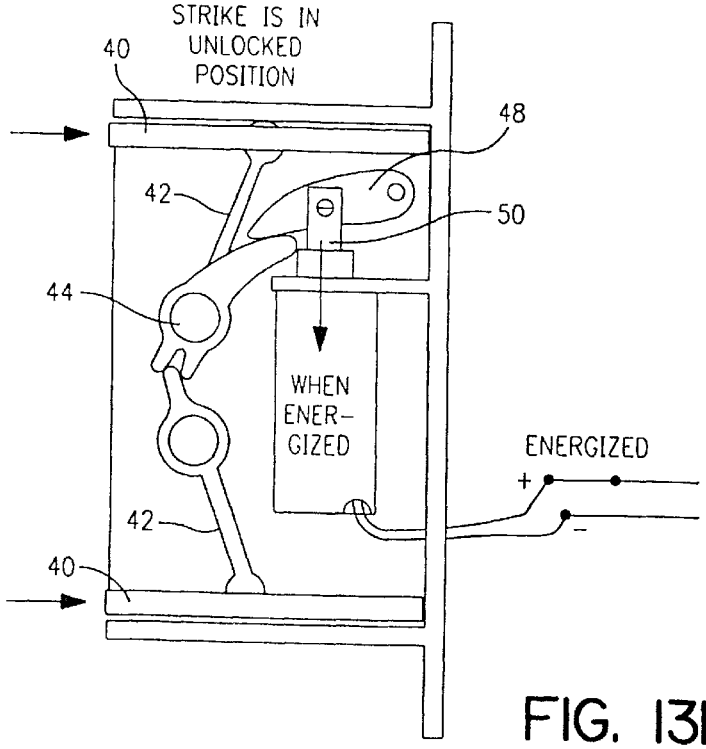
Figure 14:
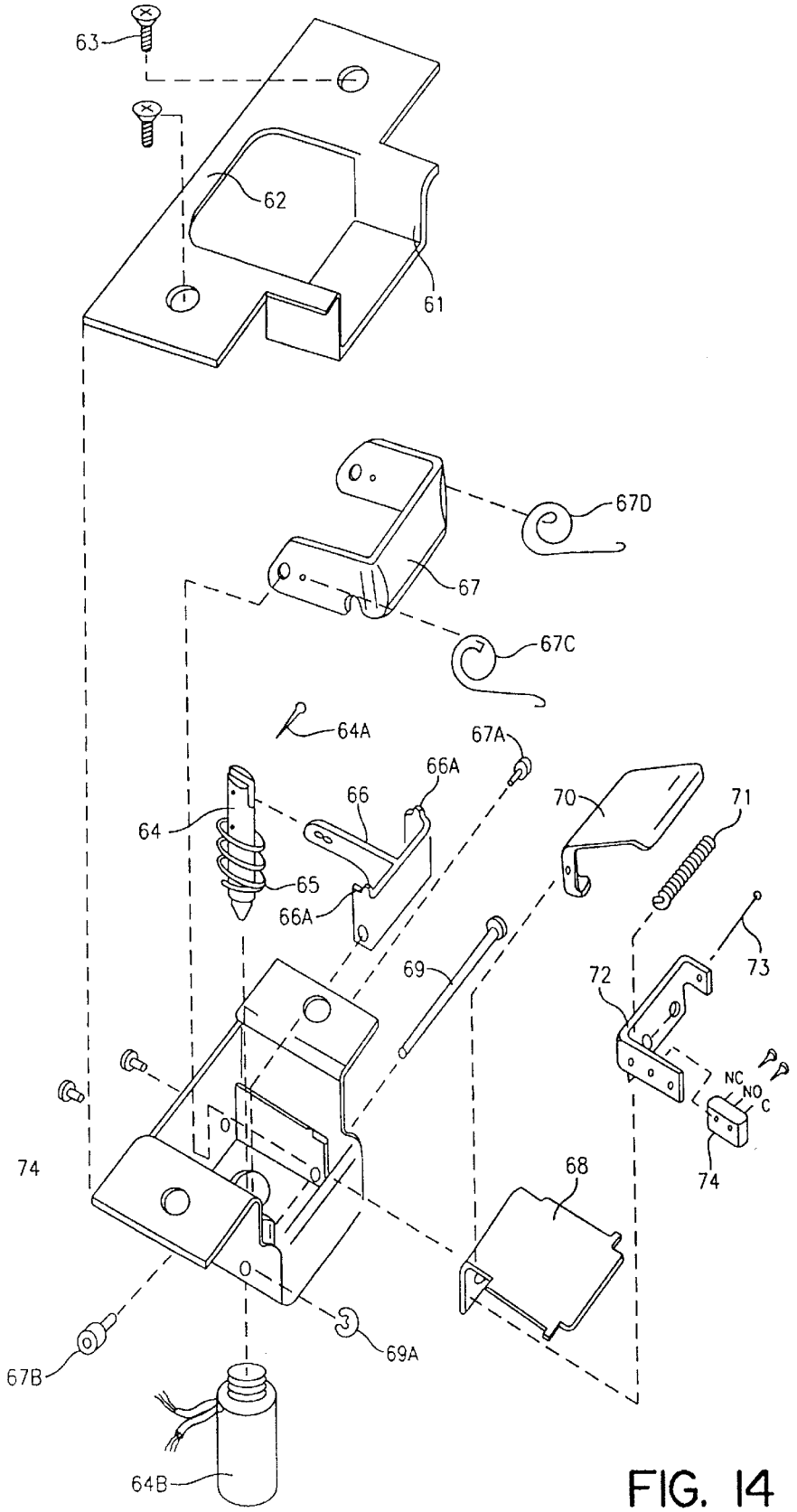
Figure 15A:
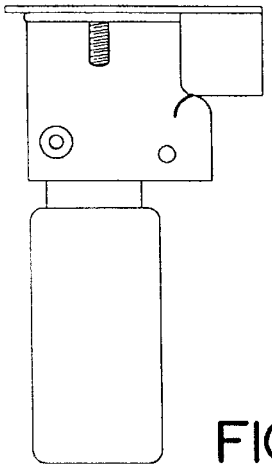
Figure 15E:
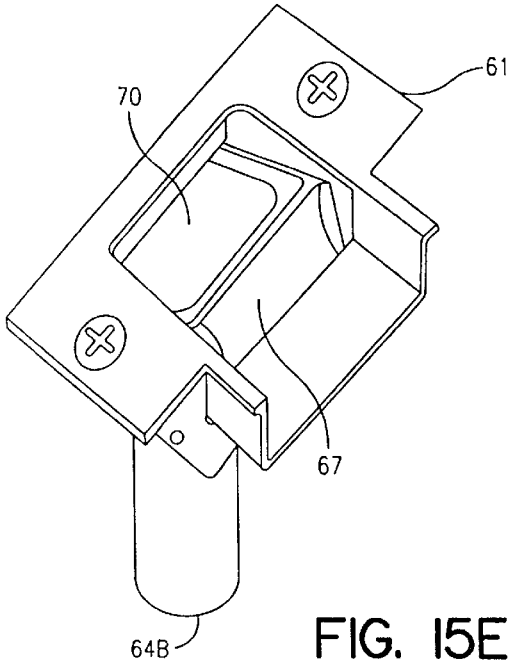
Figure 15B:
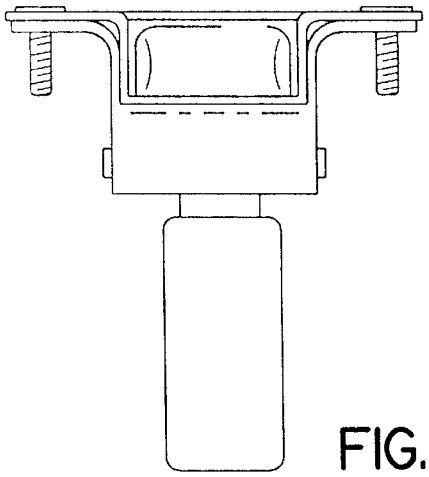
Figure 15C:
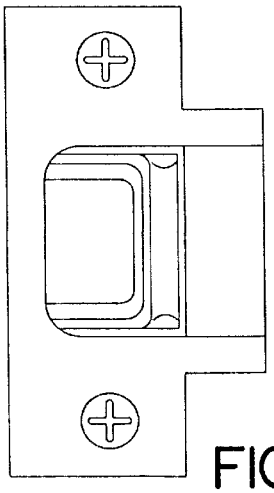
Figure 15D:
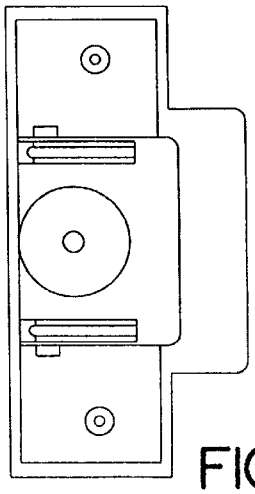

FIG. 13, 14, and 15 illustrate an other forms of the invention.

Figure 3:
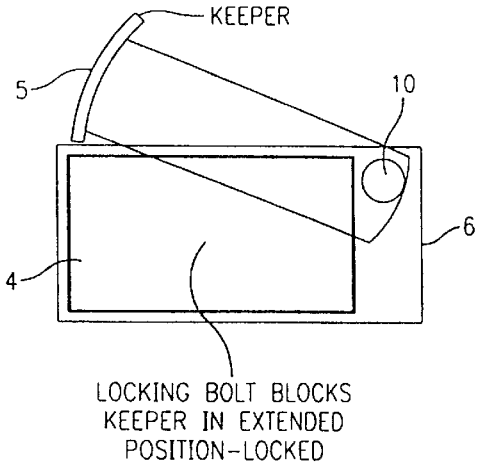
FIG. 3 is a schematic diagramatic end view showing the keeper in the normal locked position.
Figure 4:
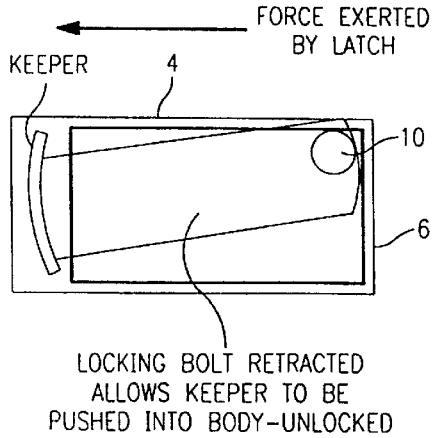
FIG. 4 is a diagramatic schematic end view of a similar to FIG. 3. but with the locking bolt retracted allowing the force exerted by the latch to move the keeper down into the strike body so that the door may be opened. As can be seen.

Referring now to FIGS. 1 and 2 wherein the solenoid 1 including its plunger 1A is indicated in the rest position and in FIG. 2 the solenoid 1 is shown in its activated position. Connected to the end of the solenoid is an actuator 2 which is arranged to be moved by means of the solenoid in a direction parallel to the direction of the motion of the solenoid. The actuator has gear teeth 2A (see FIG. 5) which engage pinions 3 also having gear teeth 3A (see FIG. 5). These gear teeth on the pinions 3 engage similar gear teeth 4A (see FIG. 5) on two locking members 4 which are moved by rotation of the gears in the direction indicated in FIG. 1 to the position shown in FIG. 2. This motion of the locking bolts 4 from the locked position to the unlocked position removes these locking bolts from under the end of a the keeper 5 which is mounted for pivotal rotation about a pivot 10. All of these members are mounted in a suitable strike case 6 which can be mounted in position on a door frame to engage the door latch. Several return springs 7 and 8 are mounted to normally bias the actuator 2 to the rest position shown in FIG. 1. As the latch passes the keeper 5 and no longer exerts a force on the keeper, the keeper is moved by the springs 9 back from the FIG. 4 the position to that shown in FIG. 3, thus allowing the locking bolts to be moved from the position in FIG. 4 to the position shown in FIG. 3 where they are in contact with front of the case 6. This is due to the combined force of springs 7 and 8 moving the actuator 2 from the position shown in FIG. 2 to the position shown in FIG. 1.

Figure 5:
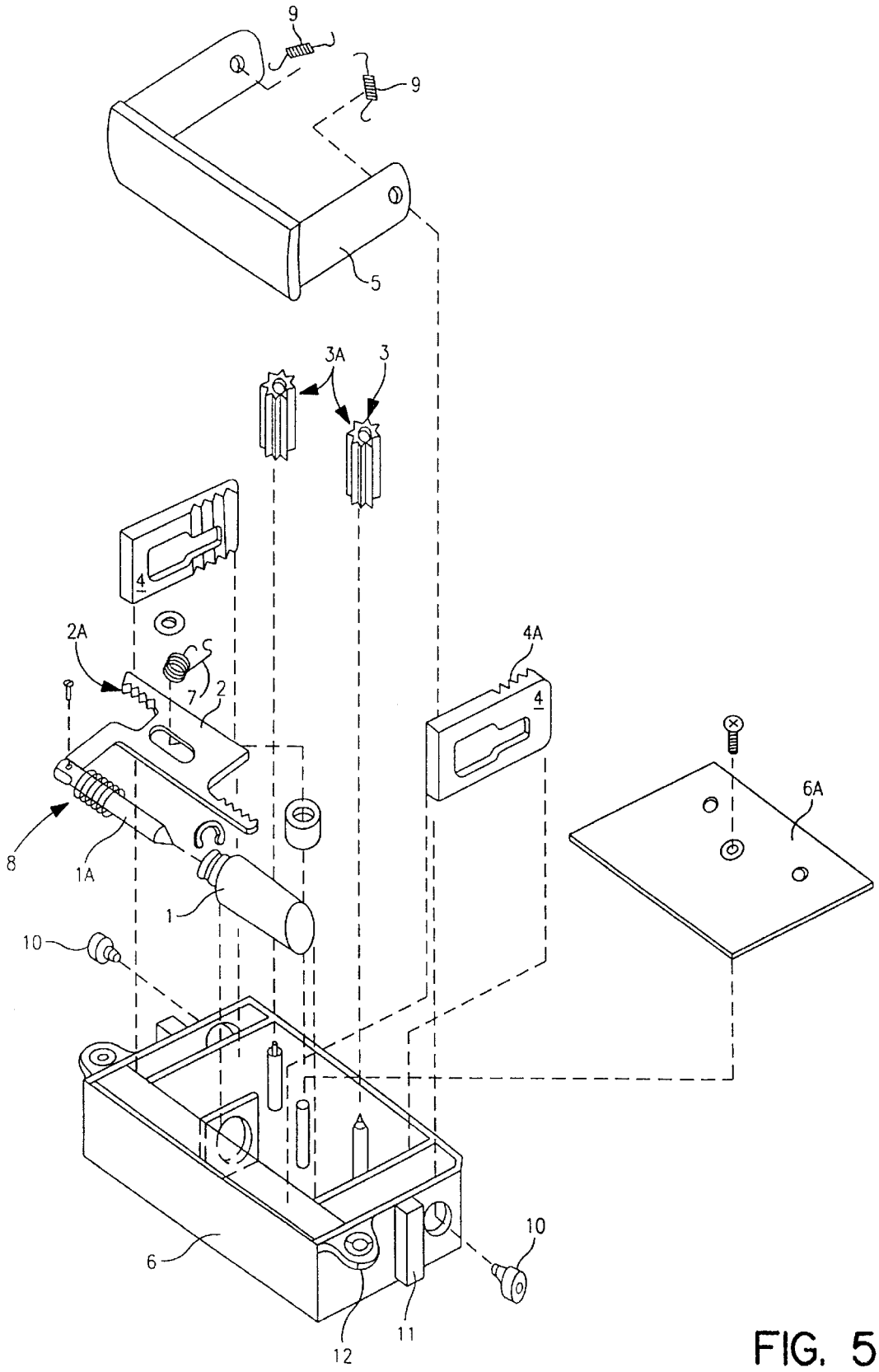
FIG. 5 is an exploded detail view of the locking mechanism of FIGS. 1 and 2.

As can be seen from an examination of FIG. 5 along with the other figures the lock mechanism is compact and very secure. It can be mounted securely into the rear surface of a rugged face plate structure so that the keeper 5 will extend from the front of the face plate. This arrangement is illustrated in FIGS. 6, 7, and 8. In these (drawings the integral tabs 11 in the side walls of the strike case 6 are shown locked into the face plate 14 and are secured for assembly by screw tabs 12.

In connection with FIG. 5, it must be understood that it is a bottom view of the strike case and the keeper 5 is inserted from the top of the strike case where it is secured by the pivot pins 10.

The principle advantage of the current invention is that provides a self-contained unit of very compact construction where a simple positive mechanisms controls its action and a structure is provided which can be surface mounted and placed in the most convenient and secure place in a door opening without having to cut away parts of the door frame.

The compact shape of the present invention and ease of mounting the face plate permits the addition of a latch monitor plate 15 which fits within the confines of the keeper 5. This addition is shown schematically in FIGS. 10, 11, and 12. This latch monitor indicates whether or not the door latch has entered the keeper.

In one preferred embodiment of the invention the latch monitor includes a thin plate 15 which is mounted on an axle 16 near one edge of the strike body 6. Adjacent one end of the axle 16 is an arm 17 extending at right angles to the axle. This arm 17 is arranged to operate a switch 18 when the plate 15 is rotated away from the upright position shown in FIGS. 10 and 12 by contact with the latch when the door is closed and the latch is positioned behind the keeper 5. The latch monitor is maintained in the upright position by suitable spring means (not shown).

A feature and advantage of the current invention resides in mounting of the latch monitor in the face plate. This simplifies installation of the latch monitor, and also permits low cost retrofitting of a latch monitor. Additionally the latch monitor may be supplied as a modular addition, thus providing manufacturing savings and making the locking assembly more attractive from a consumer's and an installer's standpoint.

Referring now to FIG. 13 there is illustrated a modification of the structure of FIGS. 1–5 wherein the locking bolts 40 are moved by pivotally mounted arms 42 which are rigidly connected to operating arm 46 on a pivot 44. The outer end of arm 46 is arranged to be engaged by lever 48 operated by solenoid 50 which moves the arm 48 from a position where the strike is in locked position (see FIG. 13A) to a position where the strike is in an unlocked position (see FIG. 13B).

Referring now to FIG. 14 and 15 there is illustrated a further modification of the invention which is particularly adapted for application for existing doors.

A door, being suspended in a door frame by a multiple of hinges and having a means of latching within the frame of the door in the closed position, has a latch which protrudes from the center of the edge of the door. The latch is operated by a key from the "secure" side of the doorway, and a knob from the inside of the doorway, both by mechanical means. When the door is in the closed position, the latch protrudes out of the door and into a strike plate which is attached to the door frame. Should it be desirable to gain entry to the locked room without the use of a key, an electrically operated strike may be substituted for the fixed strike plate in the door jamb. An electronic control system would verify the identity of the individual who has requested access by means of entering a code or by passing a specially encoded card through a card reader, and if authorized, send an electric current to the electric strike. The electric strike is manufactured as shown in FIG. 14 in an exploded view and in FIG. 15 in top perspective etc. views at the assembled latch.

The electric strike responds to the electric current as follows: the solenoid (64B), mounted on the chassis (61) perpendicularly to the edge of the door frame would create a magnetic field around a plunger (64) held partially extended outside the solenoid by a spring (65), and draw it until it is fully inside the solenoid; the plunger (64) is connected by a cotter pin (64A) to the locking lever (66), and causes the locking lever (66) to rotate around the locking lever pin (69) which is mounted through the chassis parallel to the edge of the door frame; the locking lever, as it rotates, disengages from the bottom of the keeper (67); the keeper (67), which extends out of the chassis and engages the latch is suspended in the chassis by two axles (67A & 67B) and is normally biased out of the chassis by two mirror-image springs (67C & 67D); but is free to rotate about an axis of rotation parallel to the edge of the door frame and into the chassis while the locking lever (66) has rotated out of the way of the keeper (67), and a force is applied to the keeper by the latch through the door as someone attempts to open the door; which force causes the keeper to slide off the end of the latch as it rotates. After the latch passes by the keeper, and no longer exerts any force on the keeper which is then urged out of the chassis by the two springs into its normal extended position. The locking lever is then free to rotate to its normal position of under the inside edge of the keeper when the electric current is terminated. Any force exerted on the door in an attempt to open it will be transferred to the latch, which acts on the keeper in an attempt to rotate it into the chassis but strikes the top of the locking lever and does not rotate, thereby, keeping the door securely closed. The locking lever is designed with a stop (66A) on each end which permit engagement with the bottom of the keeper, but prevent the locking lever from rotating too far to engage the keeper. The locking lever is also designed to self engage the keeper by the way it eccentrically rotates about the locking lever pin (69). In this self engaged position, the bottom of the locking, lever comes in contact with the structure of the chassis (1) resulting in all the forces which are exerted by the latch of the keeper being passed through solid stainless steel in the locking lever and chassis back to the door frame itself. This results in an exceptionally strong and durable mechanism. This strike was designed to fit an older style cutout that has been almost totally neglected by the electric strike industry. It is still very much in use, especially in older buildings with concrete filled metal frames, and quite currently being produced in the modular style walls and frames being used in most office buildings. This electric strike design is the only one capable of being installed in the type of wooden door frame found in most older homes, because of its small "footprint". It is particularly useful for residences which wish to install alarm and access control systems.

Some electronic control systems are sophisticated enough to require a signal which seeks to detect whether or not the latch has re-engaged the keeper after the door has signaled that it is in the closed position. To accommodate this requirement the strike has the means to detect the presence of the latch. The strike can be furnished from the factory with these features or they can be added by retrofitting the strike with the latch detecting package. The latch detecting package functions in the following manner: a latch detecting device having two unequal legs (70) mounts around the standard floor plate (68) and rotates in an axis of rotation parallel to the keeper; the latch detector pivots about the detector chassis plate by means of an axle (73), and is biased in a counter-clockwise rotation away from the detector chassis by means of a torsion spring (71); the longer leg of the latch detector has a return which is significantly long enough to contact a switch (74) which is mounted to a leg of the detector chassis and depresses the actuator of the switch. This design results in a very sensitive detection mechanism which only requires a slight touch from the latch in the keeper to release the actuator of the switch. Accordingly this design will accommodate and detect any length latch, as long as it can engage the keeper. This is a vast improvement over designs which required a latch to have to depress the detector to some fixed depth to change the state of the switch. Frequently that type of detector would fail to detect a short latch or if the latch spring was weaker that the detector spring, it would fail to depress the detector and change the state of the switch. No other strike in production today that is this small is available with this latch detecting feature.

A feature and advantage of the current invention is that it is low cost to manufacture, and may be employed for original installations and or retrofitting. Additionally, the strike may be supplied as a modular addition, thus providing manufacturing savings and making the locking assembly more attractive from a consumer's and an installer's standpoint.

What is claimed is:

1. A solenoid actuated door lock wherein a locking mechanism retains a latch keeper in a locking position to prevent opening of a door, comprising:

a locking means for the latch keeper a cylindrical solenoid having a co-axial plunger;

spring means biasing said solenoid plunger to a rest position, said spring means being compressed when said solenoid is electrically energized to move said plunger axially in the solenoid; means connected to said solenoid for converting linear motion of said plunger to rotary motion of a locking means actuator for maintaining the latch keeper in locked position;

said locking means being moveable from a resting, locked position to an unlocked position on energization of the solenoid, said locking means being biased by spring means to its locked position;

the latch keeper being normally biased by a spring means in position to engage a door latch;

said latch keeper being shaped to permit closing of the latch when the keeper is in biased and locked position, while preventing passage of the latch to open the door unless the latch is activated or the solenoid is activated to move the locking means to its unlocked position, wherein said means for converting linear motion to rotary motion comprises:

an actuator having a long axis spaced from and parallel with said plunger;

means connecting said plunger and actuator so that said plunger and actuator move together as a unit;

linear gear teeth carried by the actuator for engaging circumferential teeth on gear means having an axis of rotation transverse to the actuator long axis;

said gear means engaging a locking means which is moveable from a resting, locked position to an unlocked position on energization of the solenoid, said locking means being biased by spring means to its locked position a latch keeper normally biased by a spring means in position to engage a door latch, said latch keeper permitting closing of the latch when the keeper is in biased and locked position, while preventing passage of the latch to open the door unless the latch is activated or the solenoid is activated to move the locking means to its unlocked position.

2. The door lock of claim 1, wherein the keeper is mounted for rotation around an axis parallel to the solenoid axis.

3. The door lock of claim 1, wherein said actuator is additionally biased to a rest position wherein the locking means is in locked position.

4. The door lock of claim 1, wherein the actuator and connecting means are a unitary structure.

5. The lock of claim 1, wherein the locking means comprises at least one locking member which is moved in a direction transverse to the solenoid axis.

6. The lock of claim 1 wherein a locking lever is provided for holding the keeper in locked position and the locking lever and keeper are mounted for rotation about parallel axes.

7. The lock of claim 6, wherein the locking lever further comprises a stop means that engages with an inside surface of the keeper.

8. The lock of claim 1, wherein a latch detector for detecting the presence of the latch is mounted within the confines of the keeper and rotates on an axis parallel to the keeper.

9. A solenoid actuated door lock wherein a locking mechanism retains a latch keeper in a locking position to prevent opening of a door, comprising:

a locking means for the latch keeper a cylindrical solenoid having a co-axial plunger;

spring means biasing said solenoid plunger to a rest position, said spring means being compressed when said solenoid is electrically energized to move said plunger axially in the solenoid; gear means connected to said solenoid for converting linear motion of said plunger to rotary motion of a locking means actuator for maintaining the latch keeper in locked position;

said locking means being moveable from a resting, locked position to an unlocked position on energization of the solenoid, said locking means being biased by spring means to its locked position;

the latch keeper being normally biased by a spring means in position to engage a door latch;

said latch keeper permitting closing of the latch when the keeper is in biased and locked position, while preventing passage of the latch to open the door unless the latch is activated or the solenoid is activated to move the locking means to its unlocked position, wherein the gear means comprise at least one pinion gear engaging both the actuator and the locking means.

10. The door lock of claim 9, wherein the keeper is mounted for rotation around an axis parallel to the solenoid axis.

11. The door lock of claim 9, wherein said actuator is additionally biased to a rest position wherein the locking means is in locked position.

12. The door lock of claim 9, wherein the actuator and connecting means are a unitary structure.

13. The lock of claim 9, wherein the locking means comprises at least one locking member which is moved in a direction transverse to the solenoid axis.

14. The lock of claim 9, wherein a locking lever is provided for holding the keeper in locked position and the locking lever and keeper are mounted for rotation about parallel axes.

15. The lock of claim 14, wherein the locking lever further comprises a stop means that engages with an inside surface of the keeper.

16. The lock of claim 9, wherein a latch detector for detecting the presence of the latch is mounted within the confines of the keeper and rotates on an axis parallel to the keeper.

17. A door lock, comprising:

a latch keeper rotatable between a first position and a second position, in the first position the latch keeper obstructing movement of a door latch, a solenoid comprising a plunger moveable along a linear path between a first position and a second position, an actuator coupled to the plunger, the actuator moveable along a linear path parallel to the plunger between a first position and a second position, the actuator comprising a plurality of gear teeth, a pinion comprising a plurality of teeth that cooperate with the gear teeth of the actuator, a locking member comprising a plurality of gear teeth that cooperate with the teeth of the pinion, the locking member moveable along a linear path between a first position and a second position, the path being perpendicular to the path of the plunger, wherein movement of the plunger from the first position to the second position urges the locking member to move from the first position to the second position, which urges the latch keeper to move from the first position to the second position.

18. The lock of claim 17, wherein the latch keeper obstructs movement of a door latch when the solenoid is unenergized.

* * * * *